US006464515B1

(12) United States Patent
Wu

(10) Patent No.: US 6,464,515 B1
(45) Date of Patent: Oct. 15, 2002

(54) HIGH-SPEED BOARD-TO-BOARD ELECTRICAL CONNECTOR

(75) Inventor: Min-Fang Wu, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/996,449

(22) Filed: Nov. 28, 2001

(51) Int. Cl.[7] ..... H01R 13/648
(52) U.S. Cl. ..... 439/108; 439/74; 439/607
(58) Field of Search ..... 439/74, 108, 101, 439/607, 609

(56) References Cited

U.S. PATENT DOCUMENTS 5,860,814 A * 1/1999 Akama et al. ..... 439/108
5,915,976 A * 6/1999 McHugh ..... 439/74
6,019,616 A * 2/2000 Yagi et al. ..... 439/108
6,250,935 B1 * 6/2001 Mochizuki et al. ..... 439/108

* cited by examiner

*Primary Examiner*—Gary F. Paumen
(74) *Attorney, Agent, or Firm*—Wei Te Chung

(57) ABSTRACT

A board-to-board electrical connector (1) comprises an insulative housing (10), a plurality of signal contacts (20), a plurality of grounding contacts (30), and a pair of shields (40). The housing includes a central island (14) and a pair of side walls (11). The central island has a plurality of passageways (140) for receiving the signal and grounding contacts therein. The shields are attached on the side walls. The grounding contacts are interspersed among the signal contacts. Each grounding contact has a securing portion (36) extending upwardly from a tail portion (33) thereof. The securing portion engages an outer face of the corresponding shield and pushes the shield against the corresponding side wall.

1 Claim, 4 Drawing Sheets

HIGH-SPEED BOARD-TO-BOARD ELECTRICAL CONNECTOR

BACKGROUND OF THE INVENTION

1. Field of the Invention

The present invention relates to electrical board-to-board connectors, and more particularly to grounding structures of electrical board-to-board connectors.

2. Description of the Related Art

An electrical board-to-board connector assembly generally includes a pair of plug and receptacle connectors respectively mounted on two spaced PC boards. The plug and receptacle connectors are adapted to mate with each other for mechanical and electrical interconnection therebetween. Conventional board-to-board connector assemblies are generally used in low-speed transmission environments where signal noise and electromagnetic interference (EMI) are not very critical. Thus, such assemblies generally have no specific shielding or grounding contacts for removing noise and EMI therefrom. Recently, to meet the increasing use of high-speed transmission, some modified board-to-board connector assemblies have been developed. Some contacts of these modified assemblies are used as grounding contacts. The grounding contacts engage with shields of one of the connectors, for removal of EMI generated thereon.

An example of such a modified connector assembly is disclosed in U.S. Pat. No. 5,915,976. Shields of a plug connector are attached on side walls of a housing of the plug connector, and are selectively connected to some contacts of the plug connector. Each shield has an engagement arm. Correspondingly, a number of grounding contacts are disposed in a housing of the receptacle connector. The grounding contacts engage the engagement arm of the shields, and connect with corresponding contacts of the receptacle connector. Thus, EMI and noise are dissipated to ground through the shields and the grounding contacts. However, since the shields are attached on outer sides of side walls of the housing of the plug connector, and since the grounding contacts are inserted into the engagement arms of the shields, the shields are prone to separate from the side walls of the housing of the plug connector when the plug and receptacle connectors are mated with each other. This is due to pushing force of the grounding contacts acting on the engagement arms of the shields. When such separation occurs, the grounding connections between the shields and the grounding contacts are rendered useless.

SUMMARY OF THE INVENTION

Therefore, an object of the present invention is to provide a board-to-board electrical connector having grounding contacts that engage shields on side walls of a housing of the connector such that reliable and durable grounding connections are established.

To achieve the above object, a board-to-board electrical connector in accordance with the present invention comprises an insulative housing, a plurality of signal contacts, a plurality of grounding contacts, and a pair of shields. The insulative housing includes a central island and a pair of side walls. The central island has a plurality of passageways for receiving the signal and grounding contacts therein. The shields are attached on the side walls. The grounding contacts are interspersed among the signal contacts. Each grounding contact has a securing portion extending upwardly from a tail portion thereof. The securing portion engages an outer face of the corresponding shield and pushes the shield against the corresponding side wall.

DESCRIPTION OF THE PREFERRED EMBODIMENT

Figure 1:
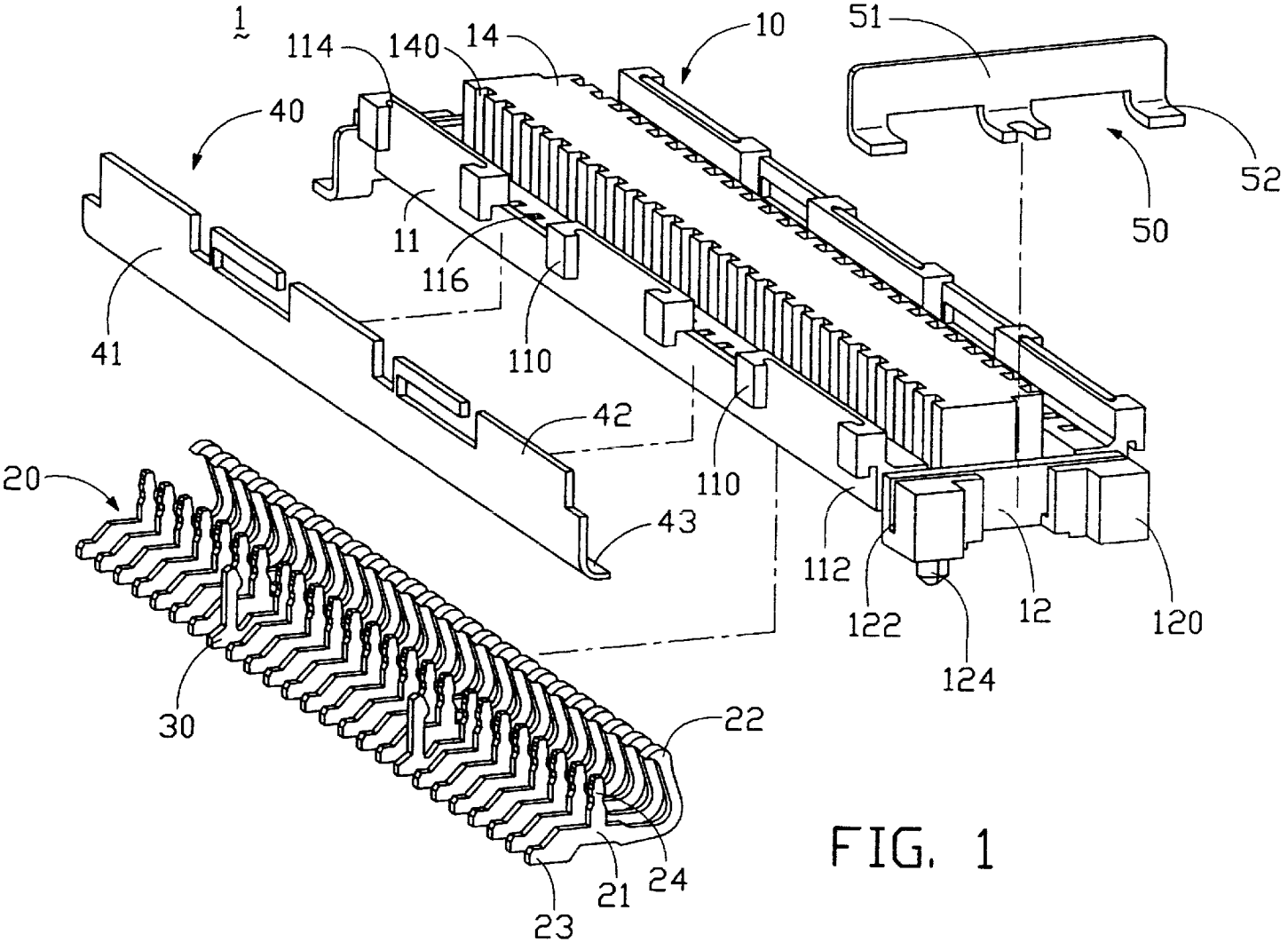
FIG. 1 is an exploded view of a board-to-board electrical connector in accordance with a preferred embodiment of the present invention.

Referring to FIG. 1, a board-to-board electrical connector 1 in accordance with a preferred embodiment of the present invention includes an insulative housing 10, a plurality of signal contacts 20, a plurality of grounding contacts 30 interspersed among the signal contacts 20, a pair of shields 40, and a pair of mounting ears 50.

The insulative housing 10 of the connector 1 is elongated, and has a central island 14, a pair of side walls 11, and a pair of end walls 12. The side and end walls 11, 12 surround the island 14. Each side wall 11 includes a plurality of pairs of spaced securing blocks 110 disposed along a longitudinal direction thereof. Each pair of securing blocks 110 defines a pair of securing slots 114 that face each other. Each securing slot 114 is defined throughout an entire height of its block 110, between top and bottom faces of the block 110. Each end wall 12 has a pair of spaced mounting blocks 120 formed thereon. A mounting slot 122 is defined between each end wall 12 and its adjacent pair of the mounting blocks 120, for receiving a mounting ear 50 therein. One of each pair of mounting blocks 120 has a locating post 124 depending from its bottom surface. The central island 14 defines a plurality of passageways 140 in opposite longitudinal sides thereof, for receiving the signal contacts 20 and grounding contacts 30. A plurality of engaging slots 116 is defined in each side wall 11, for engaging the contacts 20, 30 in the housing 10. The number of engaging slots 116 is equal to the number of passageways 140.

Each signal contact 20 has a base portion 21, a contacting portion 22 extending upwardly from an inner end of the base portion 21, an engaging portion 24 extending upwardly from a middle of the base portion 21, and a tail portion 23 extending downwardly and outwardly from an outer end of the base portion 21.

Figure 2:
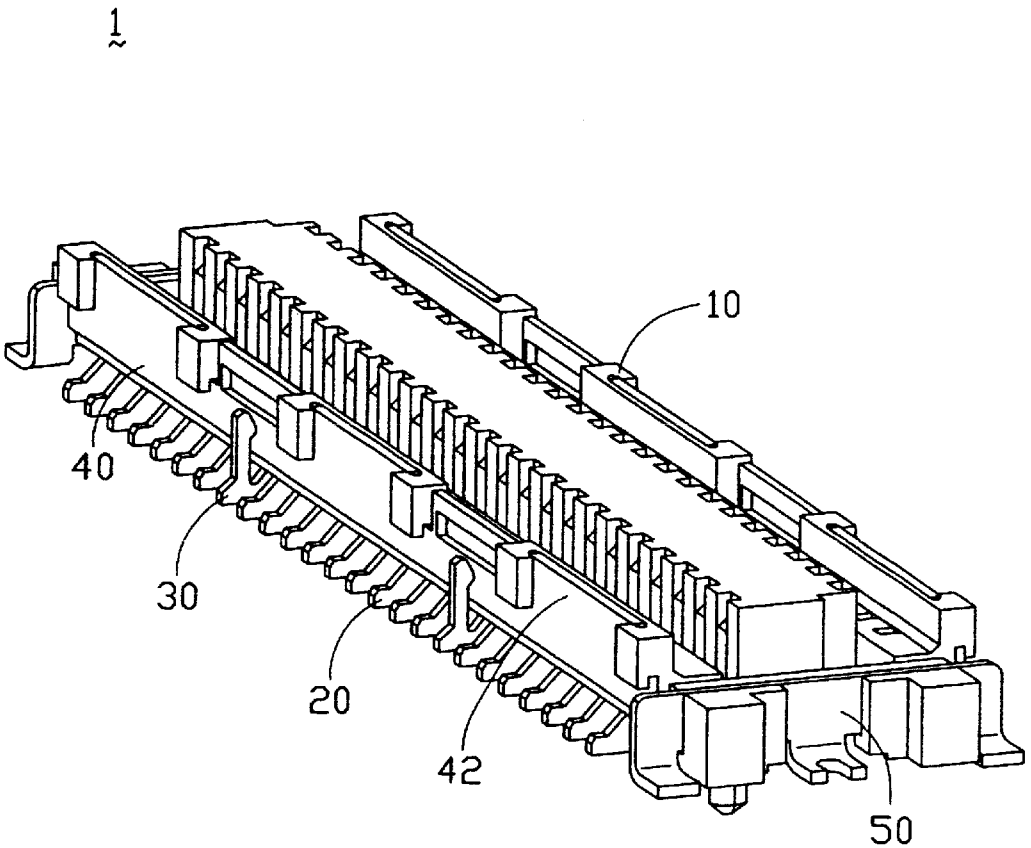
FIG. 2 is an assembled view of FIG. 1.

Also referring to FIG. 2, each shield 40 is formed by stamping a metal sheet. Each shield 40 includes a base plate 41, a plurality of spaced securing protrusions 42 extending coplanarly upwardly from an upper edge of the base plate 41, and a bottom plate 43 extending perpendicularly inwardly from a lower edge of the base p late 41. Each mounting ear 50 is also formed by stamping a metal sheet. Each mounting ear 50 includes a vertical portion 51, and a plurality of spaced soldering plates 52 bent perpendicularly outwardly from a lower edge of the vertical portion 51.

Figure 3:
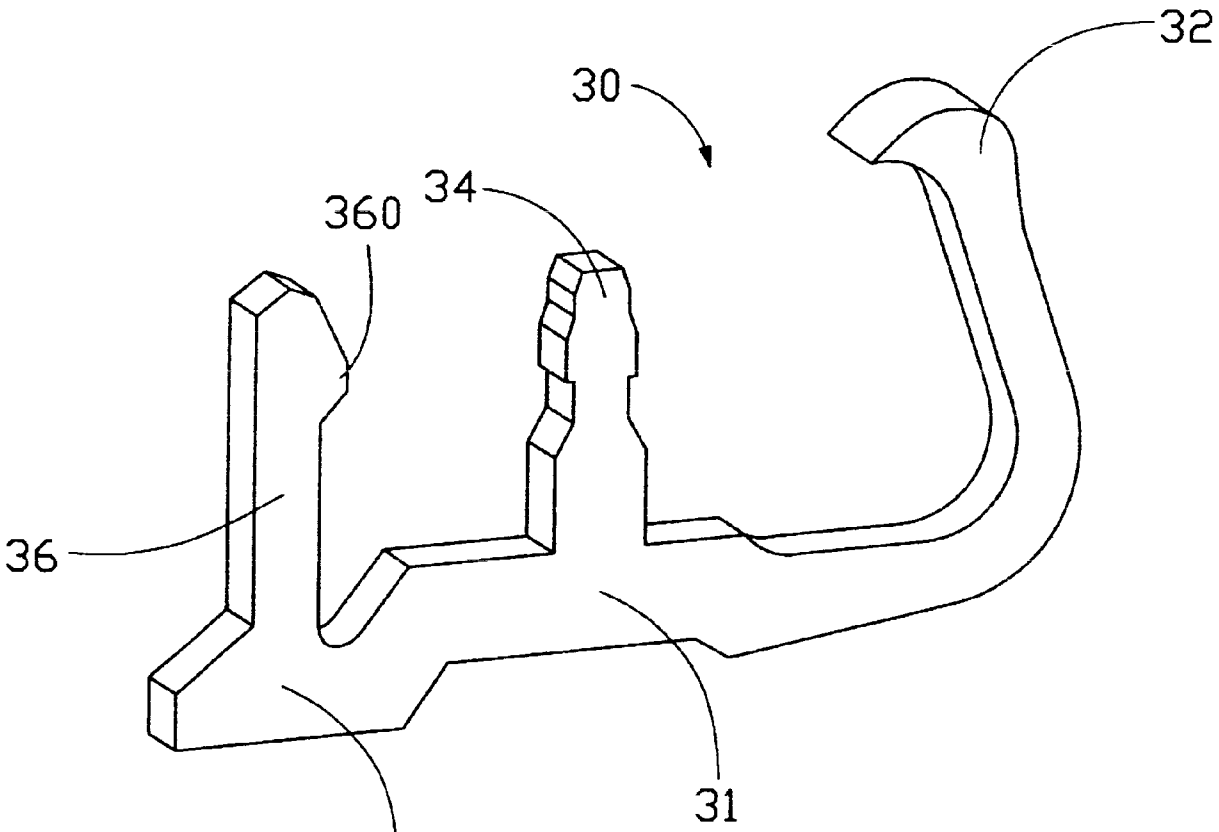
FIG. 3 is a perspective view of a grounding contact of the connector of FIG. 1.

Also referring to FIG. 3, each grounding contact 30 has a configuration similar to that of each signal contact 20. Each grounding contact 30 has a base portion 31, a contacting portion 32 extending upwardly from an inner end of the base portion 31, an engaging portion 34 extending upwardly from a middle of the base portion 31, a tail portion 33 extending downwardly and outwardly from an outer end of the base portion 31, and also a securing portion 36 extending upwardly from the tail portion 33. The securing portion 36 inwardly forms a securing end 360 at an upper part thereof.

Figure 4:
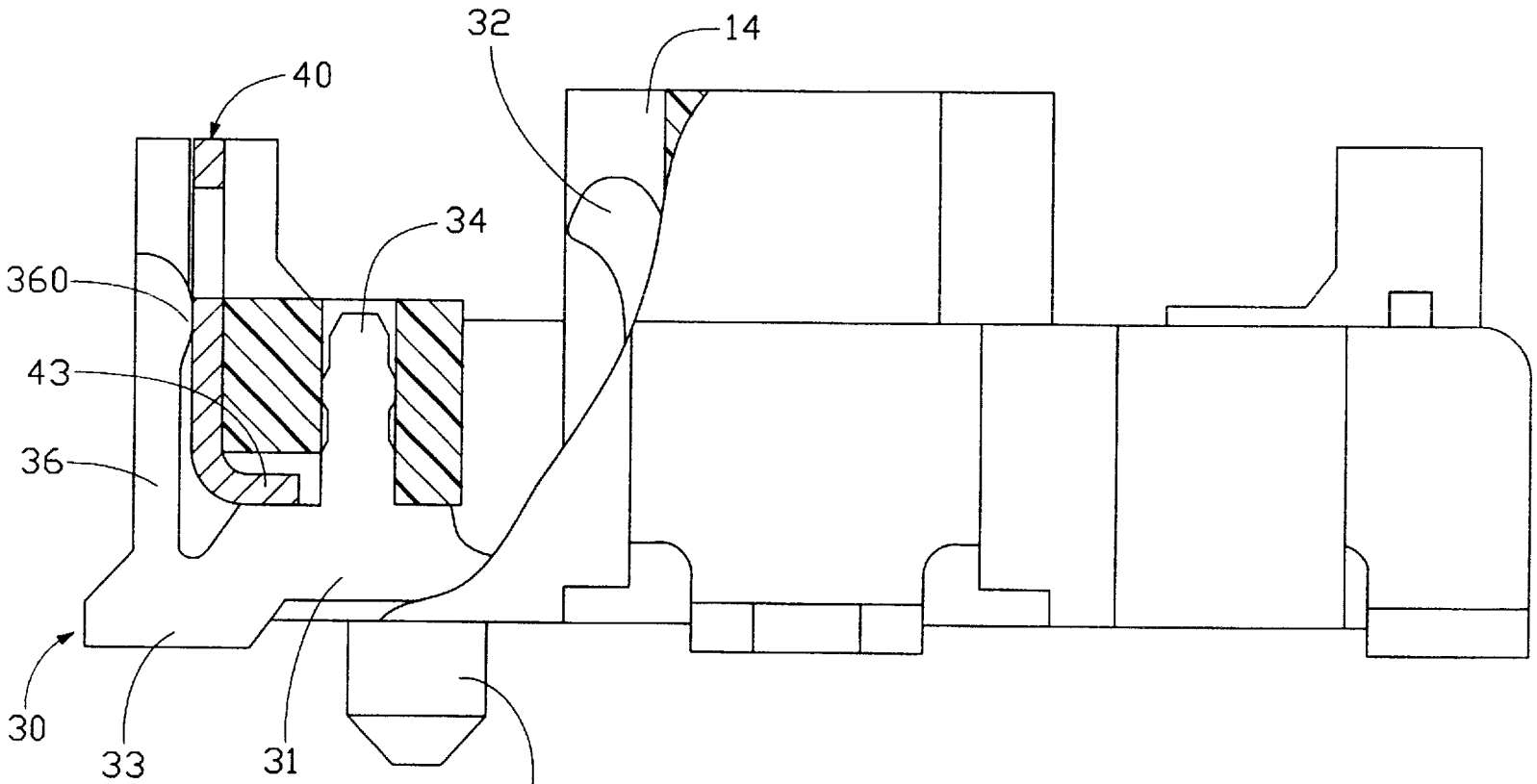
FIG. 4 is a partial cross-sectional view of FIG. 2, showing the grounding contact connecting with a shield of the connector of FIG. 1.

Also referring to FIG. 4, in assembly, each shield 40 is attached to the housing 10. The base plate 41 of the shield 40 is attached on one side wall 11 of the housing 10. The securing protrusions 42 of the shield 40 are fitted into the securing slots 114 of the housing 10. The bottom plate 43 of the shield 40 is secured to a bottom face of the side wall 11. The signal contacts 20 and grounding contacts 30 are then assembled into the housing 10. The contacting portions 22, 32 and engaging portions 24, 34 of the signal and grounding contacts 20, 30 are respectively located in the passageways 140 and engaging slots 116 of the housing 10. The tail portions 23, 33 of the signal and grounding contacts 20, 30 protrude outwardly from a bottom surface of the housing 10, for soldering to solder pads on a printed circuit board by surface mount technology. The bottom plate 43 of each shield 40 is located between the bottom face of the side wall 11 and the base portions 21, 31 of the signal and grounding contacts 20, 30. The securing ends 360 of the securing portions 36 of the grounding contacts 30 engage an outer face of the base plate 41 of the shield 40, so that the grounding contacts 30 and the shield 40 are electrically connected together. Furthermore, the securing ends 360 push the base plate 41 inwardly. The base plate 41 thus firmly abuts against the side wall 11, and the shield 40 is securely mounted to the housing 10. At the same time, reliable grounding connections between the shield 40 and the grounding contacts 30 are established. It is contemplated that the securing portion 36 is to electrically establish the grounding path and mechanically secure the base plate 41 to the side wall 11, while the retention of the contact itself with regard to the housing 10 is still preformed by the engaging portion 34. The mounting ears 50 are then fitted on opposite ends of the insulative housing 10. The vertical portions 51 of the mounting ears 50 are fitted into the mounting slots 122 at the end walls 12 of the insulative housing 10.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulative housing having a central island and a pair of side walls, the central island having a plurality of passageways defined in opposite side faces thereof;

at least one shield attached on an outer face of one of the side walls of the housing;

a plurality of signal contacts received in the passageways of the central island;

at least one grounding contact interspersed among the signal contacts, the at least one grounding contact having a securing portion, the securing portion engaging an outer face of the at least one shield thereby establishing an electrical connection therewith, the securing portion pushing the at least one shield against said one of the side wall;

wherein said one of the side walls of the insulative housing includes a plurality of spaced securing blocks, each securing block defining a securing slot, the at least one shield fitting in the securing slots;

wherein the at least one shield has a base plate, a plurality of securing protrusions extending upwardly from the base plate and fitting into the securing slots of the housing, and a bottom plate bent from the base plate and secured to a bottom face of said one of the side walls;

wherein each signal contact has a base portion, a contacting portion extending upwardly from an inner end of the base portion, a tail portion extending downwardly and outwardly from an outer end of the base portion, and an engaging portion extending upwardly from a middle of the base portion, the engaging portion fitting into a corresponding side wall;

wherein the at least one grounding contact has a base portion, a contacting portion extending upwardly from an inner end of the base portion and received in a corresponding passageway, a tail portion extending outwardly from,an outer end of the base portion and adapted for soldering to a printed circuit board, and engaging portion extending upwardly from a middle of the base portion fitting into said one of the side walls, and a securing portion extending upwardly from the tail portion;

wherein the bottom plate of the at least one shield is located between the bottom wall of said one of the side walls and the base portions of the signal and grounding contacts;

wherein the insulative hosing has a pair of end walls, each of the end walls has a mounting slot receiving a mounting ear therein, and the mounting ears are adapted to be soldered to a printed circuit board;

wherein each of the mounting ears has a vertical portion fitted into the corresponding mounting slot, and further has a plurality of spaced soldering plates bent from a lower edge of the vertical portion;

wherein the at least one grounding contact has a base portion, a contacting portion extending upwardly from an inner end of the base portion and received in a corresponding passageway, a tail portion extending outwardly from an outer end of the base portion and adapted for soldering to a printed circuit board, an engaging portion extending upwardly from a middle of the base portion for fitting into said one of the side walls, and a securing portion extending upwardly from the tail portion.

* * * * *